US008683804B2

(12) United States Patent
Boardman et al.

(10) Patent No.: US 8,683,804 B2
(45) Date of Patent: Apr. 1, 2014

(54) PREMIXING APPARATUS FOR FUEL INJECTION IN A TURBINE ENGINE

(75) Inventors: Gregory Allen Boardman, Greer, SC (US); David Martin Johnson, Simpsonville, SC (US); Ronald James Chila, Greer, SC (US); Nishant Govindbhai Parsania, Bangalore (IN); Hasan Karim, Simpsonville, SC (US); Joseph Citeno, Greenville, SC (US)

(73) Assignee: General Electric Company, Schenectady, NY (US)

( * ) Notice: Subject to any disclaimer, the term of this patent is extended or adjusted under 35 U.S.C. 154(b) by 1174 days.

(21) Appl. No.: 12/618,636

(22) Filed: Nov. 13, 2009

(65) Prior Publication Data

US 2011/0113783 A1 May 19, 2011

(51) Int. Cl.
*F02C 1/00* (2006.01)
*F02G 3/00* (2006.01)

(52) U.S. Cl.
USPC ..... 60/737; 60/738; 60/777; 60/39.822; 60/723; 60/740

(58) Field of Classification Search
USPC ..... 60/737, 738, 777, 39.822, 723, 740
See application file for complete search history.

(56) References Cited

U.S. PATENT DOCUMENTS

| | | | | |
|---|---|---|---|---|
| 5,575,153 | A * | 11/1996 | Ito et al. | 60/737 |
| 5,586,878 | A | 12/1996 | Dobbeling et al. | |
| 6,123,273 | A | 9/2000 | Loprinzo et al. | |
| 6,339,925 | B1 * | 1/2002 | Hung et al. | 60/777 |
| 6,532,742 | B2 | 3/2003 | Scarinci et al. | |
| 6,729,135 | B1 | 5/2004 | Norris et al. | |
| 6,918,255 | B2 | 7/2005 | Kaplan et al. | |
| 7,114,321 | B2 | 10/2006 | Belsom et al. | |
| 7,117,675 | B2 | 10/2006 | Kaplan et al. | |
| 7,152,409 | B2 * | 12/2006 | Yee et al. | 60/777 |
| 7,448,218 | B2 * | 11/2008 | Heilos et al. | 60/776 |
| 7,621,131 | B2 * | 11/2009 | Von Der Bank | 60/737 |
| 8,205,452 | B2 | 6/2012 | Boardman et al. | |
| 8,516,818 | B2 * | 8/2013 | Sisco et al. | 60/723 |
| 2002/0056276 | A1 * | 5/2002 | Dalla Betta et al. | 60/723 |
| 2008/0110172 | A9 * | 5/2008 | Bruck | 60/723 |
| 2009/0094984 | A1 * | 4/2009 | Colket et al. | 60/723 |
| 2011/0016866 | A1 | 1/2011 | Boardman et al. | |

FOREIGN PATENT DOCUMENTS

| | | |
|---|---|---|
| EP | 1108957 | 1/2004 |

* cited by examiner

*Primary Examiner* — Phutthiwat Wongwian
*Assistant Examiner* — Craig Kim
(74) *Attorney, Agent, or Firm* — Fletcher Yoder, P.C.

(57) ABSTRACT

In one embodiment, a system includes a fuel nozzle that includes a fuel injector that includes a fuel port and a premixer tube. The premixer tube includes a wall disposed about a central passage, multiple air ports extending through the wall into the central passage, and a catalytic region. The catalytic region includes a catalyst, disposed inside the wall along the central passage, configured to increase a reaction of fuel and air.

19 Claims, 11 Drawing Sheets

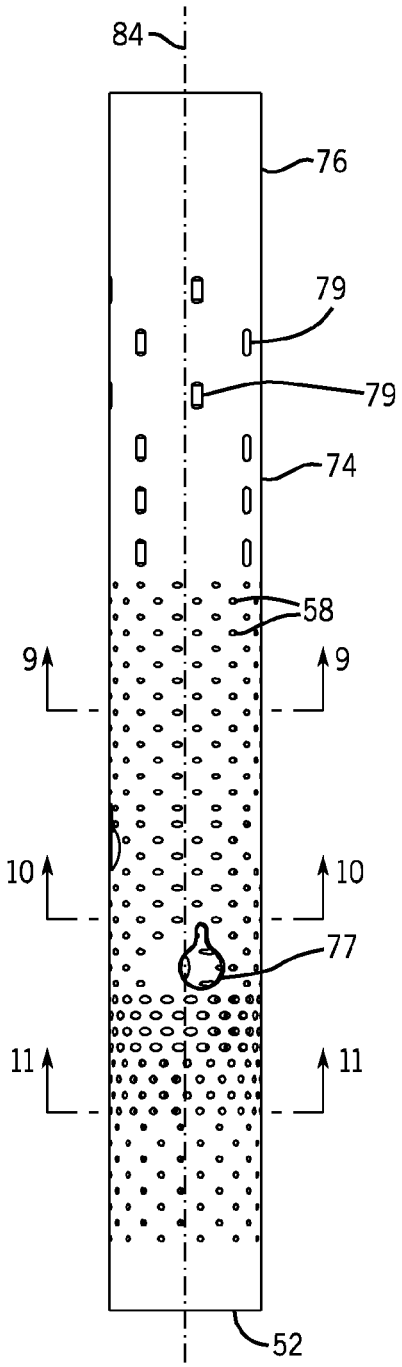
FIG. 8
FIG. 9
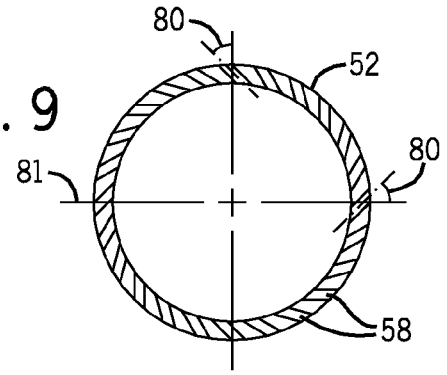
FIG. 10
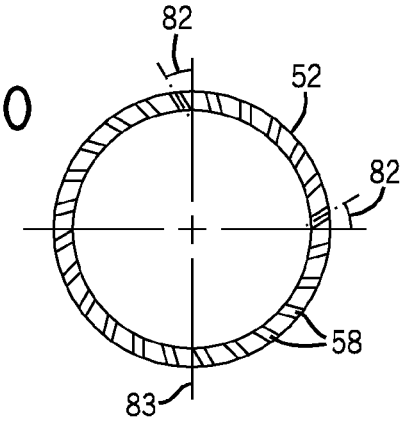
FIG. 11
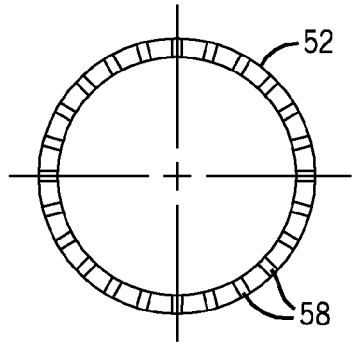

PREMIXING APPARATUS FOR FUEL INJECTION IN A TURBINE ENGINE

BACKGROUND OF THE INVENTION

The subject matter disclosed herein relates to a gas turbine engine and, more specifically, to a fuel nozzle.

Gas turbine engines include one or more combustors, which receive and combust compressed air and fuel to produce hot combustion gases. For example, the gas turbine engine may include multiple combustors positioned circumferentially around the rotational axis. Air and fuel pressures within each combustor may vary cyclically with time. These air and fuel pressure fluctuations may drive or cause pressure oscillations of the combustion gases at a particular frequency. These air and fuel pressure fluctuations may drive or cause fluctuations in the fuel to air ratio increasing the possibility of flame holding or blowback.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a fuel nozzle that includes a fuel injector that includes a fuel port and a premixer tube. The premixer tube includes a wall disposed about a central passage, multiple air ports extending through the wall into the central passage, and a catalytic region. The catalytic region includes a catalyst, disposed inside the wall along the central passage, configured to increase a reaction of fuel and air.

In a second embodiment, a system includes a fuel nozzle that includes a fuel injector that includes a fuel port and a premixer tube. The premixer tube includes a wall disposed about a central passage, multiple air ports extending through the wall into the central passage, and an outlet region. The outlet region includes a bell-shaped wall and a flame stabilizer.

In a third embodiment, a system includes a fuel nozzle that includes a fuel injector that includes a fuel port and a premixer tube. The premixer tube includes a wall disposed about a central passage and multiple air ports extending through the wall into the central passage. The multiple airports include a first teardrop shaped air port having first and second portions disposed one after another along a flow direction through the central passage and where the second portion is narrower than the first portion, and the second portion is elongated along the flow direction.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein:

FIG. 8 is a side view of a premixer tube, as shown in FIG. 7, in accordance with certain embodiments of the present technique;

FIG. 9 is a cross-sectional side view of a premixer tube, taken along line 9-9 of FIG. 8, in accordance with certain embodiments of the present technique;

FIG. 10 is a cross-sectional side view of a premixer tube, taken along line 10-10 of FIG. 8, in accordance with certain embodiments of the present technique;

FIG. 11 is a cross-sectional side view of a premixer tube, taken along line 11-11 of FIG. 8, in accordance with certain embodiments of the present technique;

DETAILED DESCRIPTION OF THE INVENTION

Figure 1:
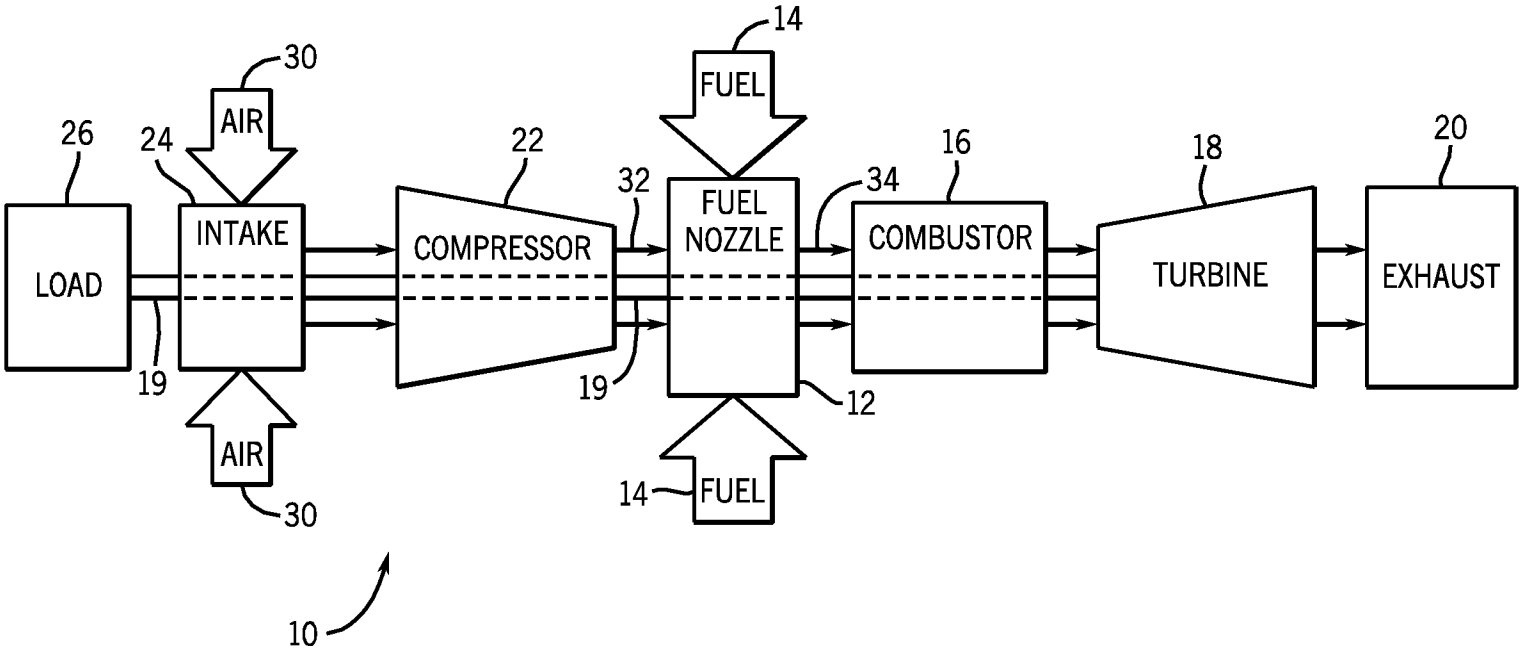
FIG. 1 is a block diagram of a turbine system having a fuel nozzle coupled to a combustor, wherein the fuel nozzle is configured to reduce flame holding and blowback in accordance with certain embodiments of the present technique.

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

Embodiments of the present disclosure may improve mixing of the air-fuel mixture, improve the stability of the air-fuel mixture within the mixing portion of the combustor, and improve the flame stability at the nozzle outlet. Combustor driven oscillations may be defined as pressure oscillations in the combustor as the fuel and air enter, mix, and combust within the combustor. The combustor driven oscillations may cause fluctuations in the fuel to air ratio increasing the risk for flame holding or blowback. As discussed in detail below, these combustor driven oscillations may be substantially reduced or minimized by reducing upstream pressure oscillations in the fuel and air supplied to the combustor. For example, the upstream pressure oscillations may be substantially reduced or minimized via unique pressure balancing features in the fuel nozzles of the turbine engine. Accordingly, certain embodiments may pre-react a portion of the fuel and air in each fuel nozzle by including one or more premixer tubes with air ports and a catalytic region, e.g., a premixer tube with a catalyst disposed inside the wall along the central passage. Some embodiments may decelerate the flow of the mixture, recover pressure within the premixer tube prior to combustion of the mixture, and anchor the flame, e.g., a premixer tube with an outlet region that includes a bell-shaped wall and flame stabilizer. Some embodiments may include one or more premixer tubes with multiple air ports, where the air ports include a teardrop shaped air port having a first portion and a second portion disposed one after another along the flow direction through the premixer tube. The second portion of the teardrop shaped air port is narrower than the first portion and elongated along the flow direction to improve the mixing of the fuel and to increase the swirl in the premixer tube.

Turning now to the drawings and referring first to FIG. 1, a block diagram of an embodiment of a gas turbine system 10 is illustrated. The diagram includes fuel nozzle 12, fuel supply 14, and combustor 16. As depicted, fuel supply 14 routes a liquid fuel and/or gas fuel, such as natural gas, to the turbine system 10 through fuel nozzle 12 into combustor 16. As discussed below, the fuel nozzle 12 is configured to inject and mix the fuel with compressed air while minimizing combustor driven oscillations. The combustor 16 ignites and combusts the fuel-air mixture, and then passes hot pressurized exhaust gas into a turbine 18. The exhaust gas passes through turbine blades in the turbine 18, thereby driving the turbine 18 to rotate. In turn, the coupling between blades in turbine 18 and shaft 19 will cause the rotation of shaft 19, which is also coupled to several components throughout the turbine system 10, as illustrated. Eventually, the exhaust of the combustion process may exit the turbine system 10 via exhaust outlet 20.

In an embodiment of turbine system 10, compressor vanes or blades are included as components of compressor 22. Blades within compressor 22 may be coupled to shaft 19, and will rotate as shaft 19 is driven to rotate by turbine 18. Compressor 22 may intake air to turbine system 10 via air intake 24. Further, shaft 19 may be coupled to load 26, which may be powered via rotation of shaft 19. As appreciated, load 26 may be any suitable device that may generate power via the rotational output of turbine system 10, such as a power generation plant or an external mechanical load. For example, load 26 may include an electrical generator, a propeller of an airplane, and so forth. Air intake 24 draws air 30 into turbine system 10 via a suitable mechanism, such as a cold air intake, for subsequent mixture of air 30 with fuel supply 14 via fuel nozzle 12. As will be discussed in detail below, air 30 taken in by turbine system 10 may be fed and compressed into pressurized air by rotating blades within compressor 22. The pressurized air may then be fed into fuel nozzle 12, as shown by arrow 32. Fuel nozzle 12 may then mix the pressurized air and fuel, shown by numeral 34, to produce a suitable mixture ratio for combustion, e.g., a combustion that causes the fuel to more completely burn, so as not to waste fuel or cause excess emissions. An embodiment of turbine system 10 includes certain structures and components within fuel nozzle 12 to reduce combustor driven oscillations, thereby increasing performance and reducing emissions.

Figure 2:
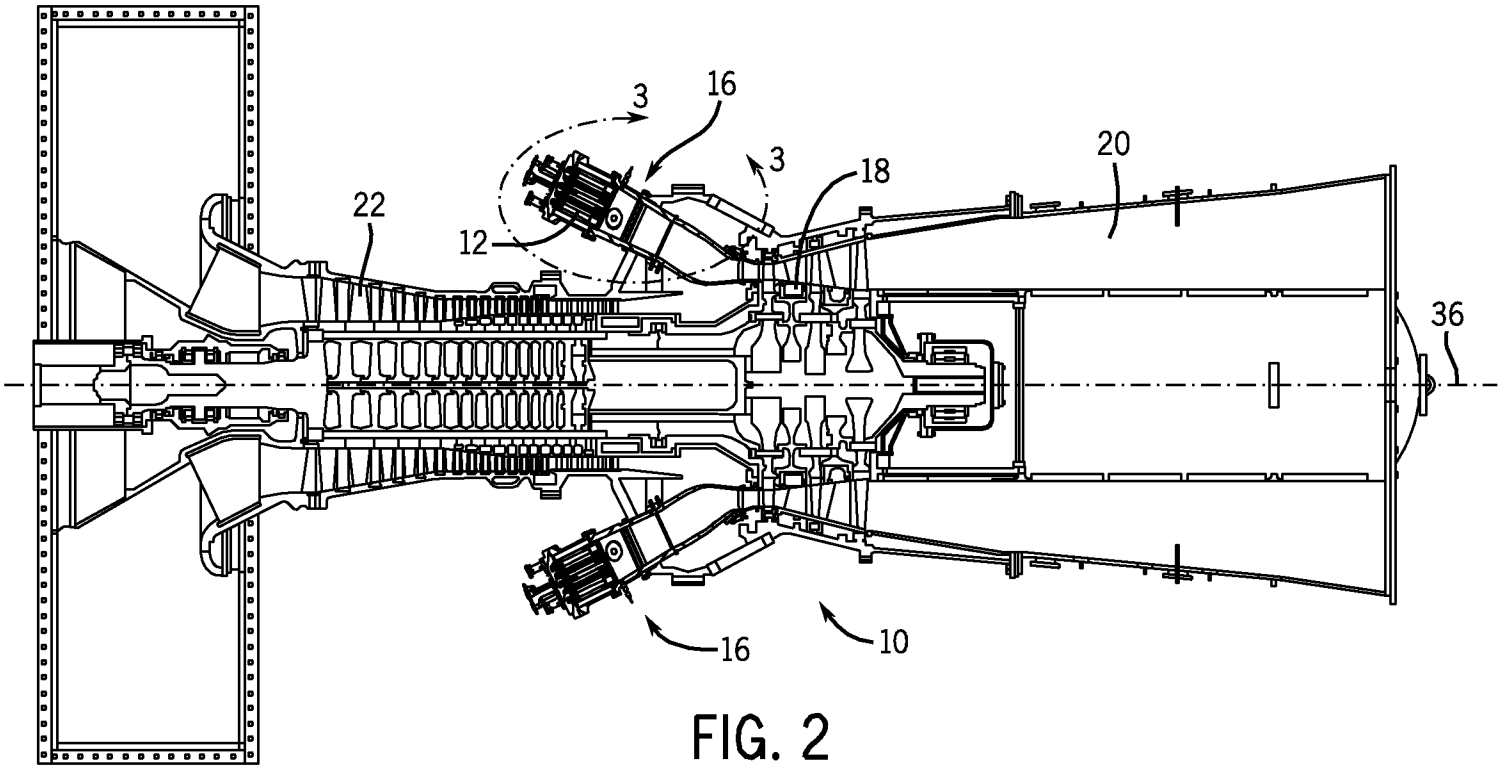
FIG. 2 is a cutaway side view of the turbine system, as shown in FIG. 1, in accordance with certain embodiments of the present technique.

FIG. 2 shows a cutaway side view of an embodiment of turbine system 10. As depicted, the embodiment includes compressor 22, which is coupled to an annular array of combustors 16, e.g., six, eight, ten, or twelve combustors 16. Each combustor 16 includes at least one fuel nozzle 12 (e.g., 1, 2, 3, 4, 5, 6, 7, 8, 9, 10, or more), which feeds an air-fuel mixture to a combustion zone located within each combustor 16. Combustion of the air-fuel mixture within combustors 16 will cause vanes or blades within turbine 18 to rotate as exhaust gas passes toward exhaust outlet 20. As will be discussed in detail below, certain embodiments of fuel nozzle 12 include a variety of unique features to reduce combustor driven oscillations, thereby improving combustion, reducing undesirable exhaust emissions, and improving fuel consumption.

Figure 3:
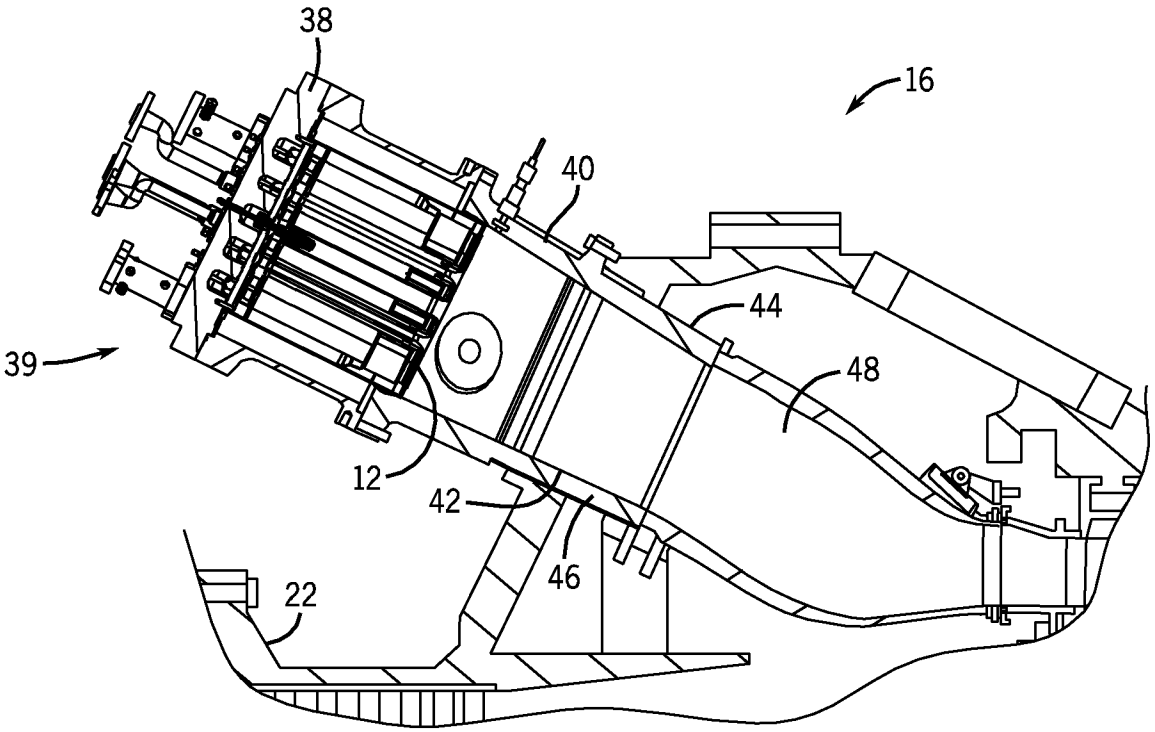
FIG. 3 is a cutaway side view of the combustor, as shown in FIG. 1, with a fuel nozzle coupled to an end cover of the combustor in accordance with certain embodiments of the present technique.

A detailed view of an embodiment of combustor 16, as shown in FIG. 2, is illustrated in FIG. 3. In the diagram, fuel nozzle 12 is attached to end cover 38 at a base or head end 39 of combustor 16. Compressed air and fuel are directed through end cover 38 to the fuel nozzle 12, which distributes an air-fuel mixture into combustor 16. The fuel nozzle 12 receives compressed air from the compressor 22 via a flow path around and partially through the combustor 16 from a downstream end to an upstream end (e.g., head end 39) of the combustor 16. In particular, the turbine system 10 includes a casing 40, which surrounds a liner 42 and flow sleeve 44 of the combustor 16. The compressed air passes between the casing 40 and the combustor 16 until it reaches the flow sleeve 44. Upon reaching the flow sleeve 44, the compressed air passes through perforations in the flow sleeve 44, enters a hollow annular space between the flow sleeve 44 and liner 42, and flows upstream toward the head end 39. In this manner, the compressed air effectively cools the combustor 16 prior to mixing with fuel for combustion. Upon reaching the head end 39, the compressed air flows into the fuel nozzle 12 for mixing with the fuel. In turn, the fuel nozzle 12 may distribute a pressurized air-fuel mixture into combustor 16, wherein combustion of the mixture occurs. The resultant exhaust gas flows through transition piece 48 to turbine 18, causing blades of turbine 18 to rotate, along with shaft 19. In general, the air-fuel mixture combusts downstream of the fuel nozzle 12 within combustor 16. Mixing of the air and fuel streams may depend on properties of each stream, such as fuel heating value, flow rates, and temperature. In particular, the pressurized air may be at a temperature, around 650-900° F. and fuel may be around 70-500° F. As discussed in detail below, the fuel nozzle 12 includes various features to reduce pressure oscillations or variations in the air and/or fuel flows prior to injection into the combustor 16, thereby substantially reducing combustor driven oscillations.

Figure 4:
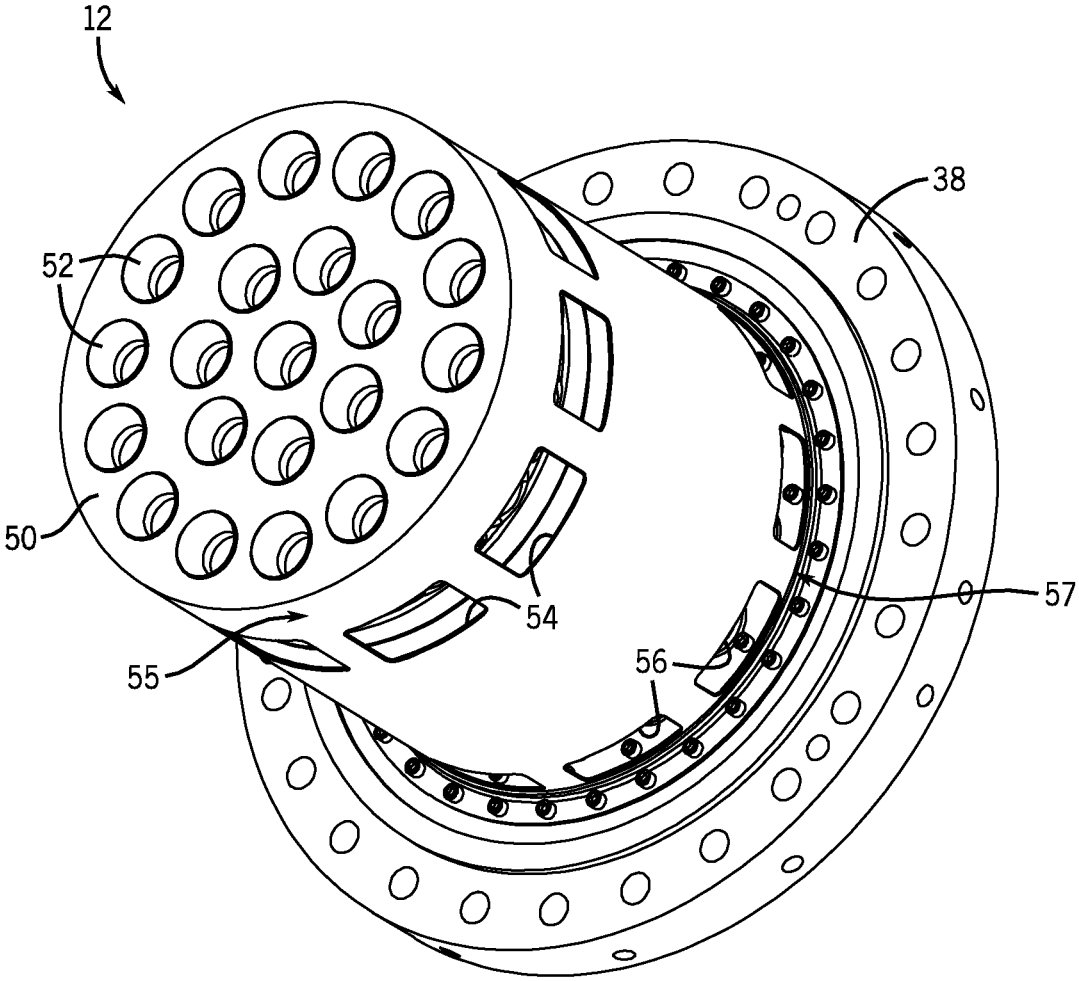
FIG. 4 is a perspective view of the fuel nozzle, as shown in FIG. 3, with a set of premixer tubes in accordance with certain embodiments of the present technique.

FIG. 4 shows a perspective view of a fuel nozzle 12 that may be used in the combustor 16 of FIG. 3. The fuel nozzle 12 includes a mini-nozzle cap 50 with multiple premixer tubes 52. First windows 54 may be position around the circumference of the mini-nozzle cap 50 to facilitate air flow into the cap 50 near a downstream portion 55 of the cap 50. Second windows 56 may also be located around the circumference of the mini-nozzle cap 50 closer to the end cover 38 to provide additional air flow near an upstream portion 57 of the cap 50. However, as discussed in further detail below, fuel nozzle 12 may be configured to direct air flow from both windows 54 and 56 into the premixer tubes 52 in a greater amount at the upstream portion 57 rather than the downstream portion 55. The number of first windows 54 and second windows 56 may vary based on desired air flow into the mini-nozzle cap 50. For example, the first and second windows 54 and 56 each may include a set of approximately 2, 4, 6, 8, 10, 12, 14, 16, 18, or 20 windows distributed about the circumference of the mini-nozzle cap 50. However, the size and shape of these windows may be configured to conform to particular combustor 16 design considerations. The mini-nozzle cap 50 may be secured to the end cover 38, forming a complete fuel nozzle assembly 12.

As will be discussed in detail below, fuel and air may mix within the premixer tubes 52 in a manner reducing pressure oscillations prior to injection into the combustor 16. Air from the windows 54 and 56 may flow into the premixer tubes 52 and combine with fuel flowing through the end cover 38. The fuel and air may mix as they travel along the length of the premixer tubes 52. For example, each premixer tube 52 may include an increased length, angled air ports to induce swirl, and/or a non-perforated section downstream from a perforated section. These features may substantially increase residence time of the fuel and air and dampen pressure oscillations within the premixer tube 52. Upon exiting the tubes 52, the fuel-air mixture may be ignited, generating hot gas which powers the turbine 18.

Figure 5:
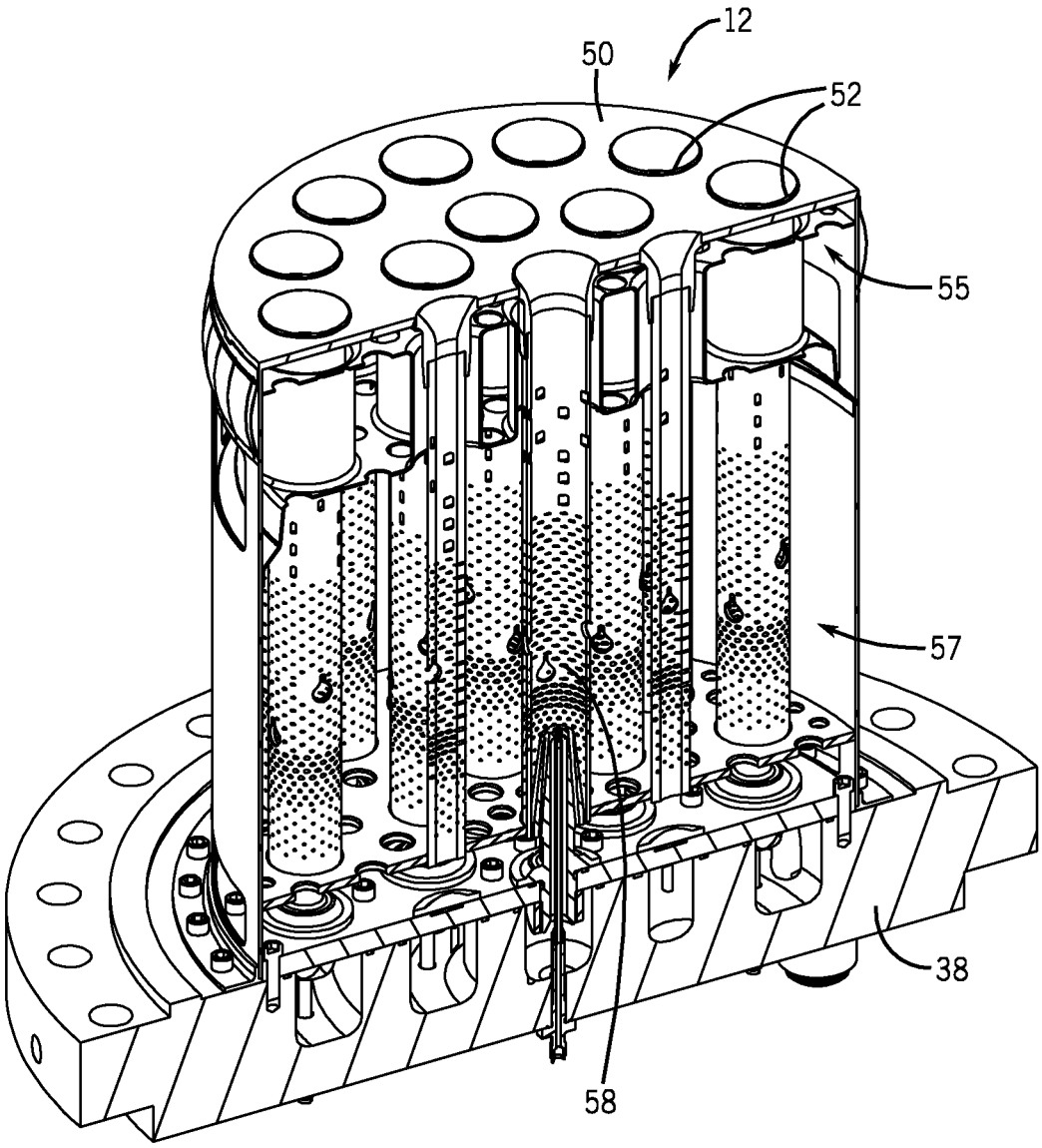
FIG. 5 is a cutaway perspective view of the fuel nozzle, as shown in FIG. 4, in accordance with certain embodiments of the present technique.

FIG. 5 presents a cross-section of the fuel nozzle 12 depicted in FIG. 4. This cross-section shows the premixer tubes 52 within the mini-nozzle cap 50. As can be seen in FIG. 5, each premixer tube 52 contains multiple air ports 58 along the longitudinal axis of the tube 52. These air ports 58 extend through the wall of the premixer tube 52 and direct air from the windows 54 and 56 into the premixer tubes 52. The number of air ports and the size of each air port may vary based on desired air flow into each premixer tube 52. Fuel may be injected through the end cover 38 and mix with the air entering through the air ports 58. Again, the position, orientation, and general arrangement of the air ports 58 may be configured to substantially increase residence time and dampen pressure oscillations in the fuel and air, thereby in turn substantially reducing oscillations in the combustion process occurring within the combustor 16 downstream from the fuel nozzle 12. For example, the percentage of air ports 58 may be higher in the upstream portion 57 rather than the downstream portion 55 of each premixer tube 52. Air entering through air ports 58 further upstream 57 travels a greater distance through the premixer tube 52, whereas air entering through air ports 58 further downstream 55 travels a shorter distance through the premixer tube 52. In certain embodiments, the air ports 58 may be sized relatively larger in the upstream portion 57 and relatively smaller in the downstream portion 55 of the premixer tube 52, or vice versa. For example, larger air ports 58 in the upstream portion 57 may result in a greater percentage of air flow entering through the upstream portion 57 of the premixer tube 52, which in turn leads to greater residence time in the premixer tube 52. In some embodiments, the air ports 58 may be angled to induce swirl to increase mixing, increase residence time, and dampen pressure oscillations in the air and fuel flows through the premixer tube 52. Eventually, after substantial dampening of the pressure oscillations in the fuel and air flows, the premixer tube 52 injects the fuel-air mixture into the combustor 16 for combustion.

Figure 6:
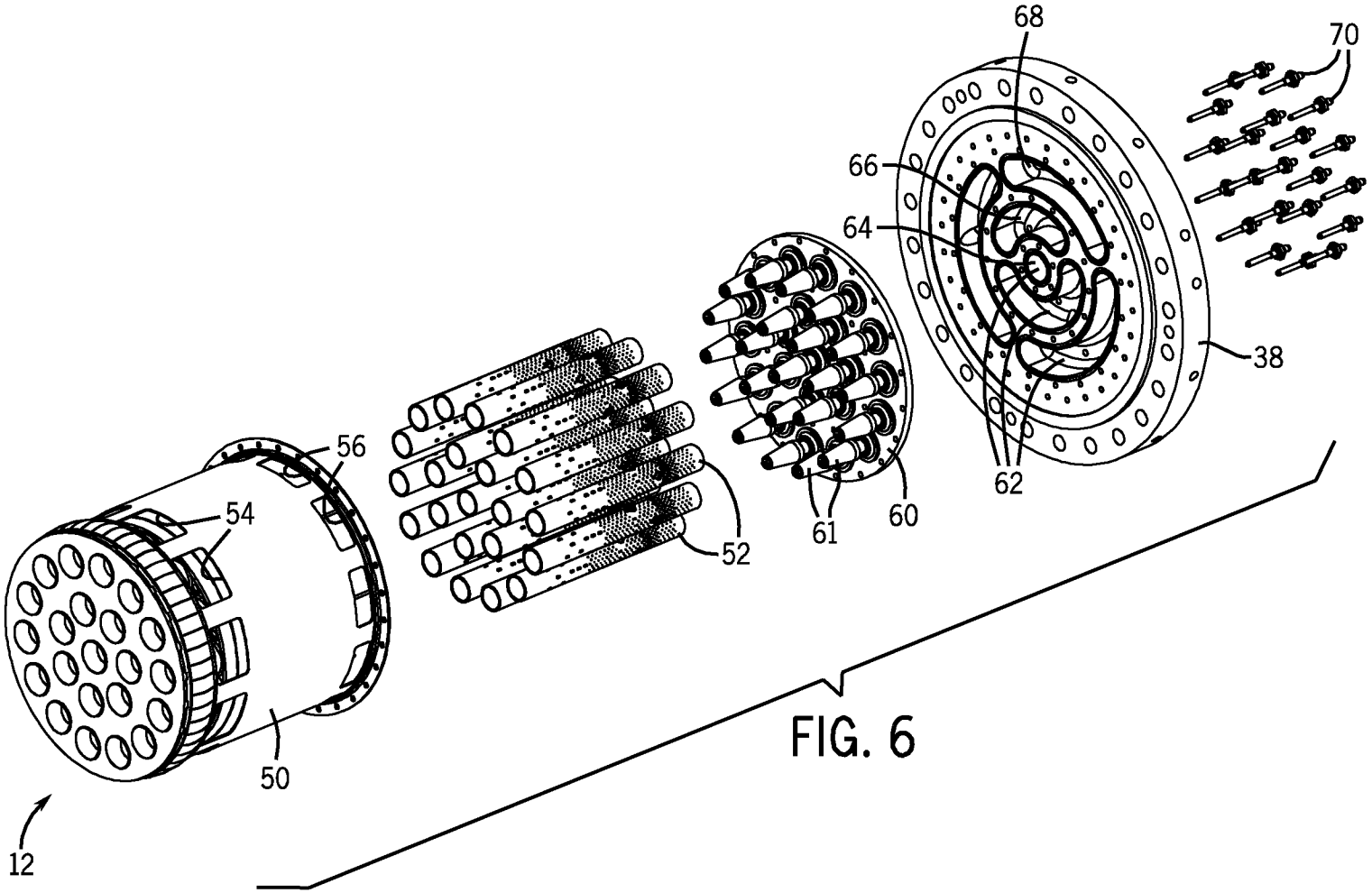
FIG. 6 is an exploded perspective view of the fuel nozzle, as shown in FIG. 4, in accordance with certain embodiments of the present technique.

FIG. 6 is an exploded view of the fuel nozzle 12 depicted in FIG. 4. This figure further shows the configuration of premixer tubes 52 within the mini-nozzle cap 50. FIG. 6 also presents another perspective of the first windows 54 and the second windows 56. In addition, this figure illustrates the paths and structures for fuel supply into the base of each premixer tube 52.

Turbine engines may operate on liquid fuel, gaseous fuel, or a combination of the two. The fuel nozzle 12 presented in FIG. 6 facilitates both liquid and gaseous fuel flow into the premixer tubes 52. However, other embodiments may be configured to operate solely on liquid fuel or gaseous fuel. The gaseous fuel may enter the premixer tubes 52 through a gas injector plate 60. This plate 60, as shown, contains multiple cone-shaped orifices 61 that supply gas to the premixer tubes 52. Gas may be supplied to the gas injector plate 60 through the end cover 38. The end cover 38 may include multiple galleries 62 (e.g., annular or arcuate shaped recess) that direct gas from a fuel supply 14 to the gas injector plate 60. The illustrated embodiment includes three galleries 62, e.g., first gallery 64, second gallery 66, and third gallery 68. Second gallery 66 and third gallery 68 are divided into multiple sections. However, continuous annular galleries 66 and 68 may be employed in alternative embodiments. The number of galleries may vary based on the configuration of the fuel nozzle 12. As can be seen in this figure, the gas orifices 61 are arranged in two concentric circles surrounding a central orifice 61. In this configuration, the first gallery 64 may supply gas to the central orifice 61, the second gallery 66 may supply gas to the inner circle of orifices 61, and the third gallery 68 may supply gas to the outer circle of orifices 61. In this manner, gaseous fuel may be supplied to each premixer tube 52.

Liquid fuel may be supplied to the premixer tubes 52 through multiple liquid atomizer sticks or liquid fuel cartridges 70. Each liquid fuel cartridge 70 may pass through the end cover 38 and the gas injector plate 60. As will be discussed below, the tip of each liquid fuel cartridge 70 may be located within each gas orifice 61. In this configuration, both liquid and gaseous fuel may enter the premixer tubes 52. For example, the liquid fuel cartridges 70 may inject an atomized liquid fuel into each premixer tube 52. This atomized liquid may combine with the injected gas and the air within the premixer tubes 52. The mixture may then be ignited as it exits the fuel nozzle 12. Furthermore, each liquid fuel cartridge 70 may include a fluid coolant (e.g., water) passage to inject a liquid spray (e.g., water spray) into the premixer tube 52. In certain embodiments, the unique features of the premixer tubes 52 may substantially reduce pressure fluctuations in fluid supplies including air, gas fuel, liquid fuel, liquid coolant (e.g., water), or any combination thereof. For example, the air ports 58 in the premixer tubes 52 may be configured to impinge the gas fuel, liquid fuel, and/or liquid coolant (e.g., water) in a manner increasing mixing, increasing residence time, and dampening pressure oscillations prior to injection of the mixture into the combustor 16.

Figure 7:
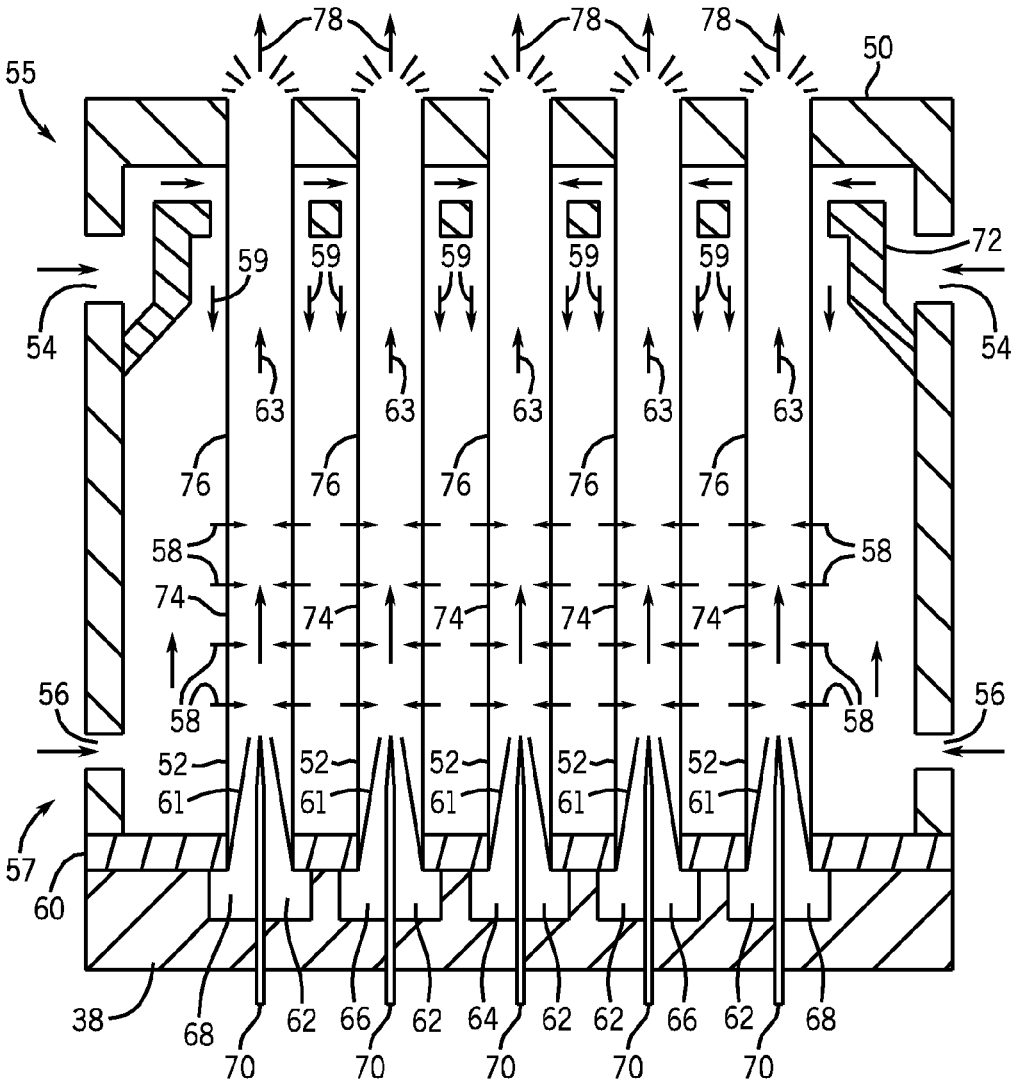
FIG. 7 is a cross-sectional side view of the fuel nozzle, as shown in FIG. 4, in accordance with certain embodiments of the present technique.

FIG. 7 shows a cross-section of the fuel nozzle 12 depicted in FIG. 4. As previously discussed, air may enter the mini-nozzle cap 50 through first windows 54 and second windows 56. This figure shows the path of air through the windows 54 and 56 to the air ports 58, through the air ports 58, and lengthwise along the premixer tubes 52. The first windows 54 direct air into the downstream portion 55 of the mini-nozzle cap 50 to facilitate cooling before the air passes into the premixer tubes 52 at the upstream portion 57. In other words, the air flow passes along an exterior of the premixer tubes 52 in an upstream direction 59 from the downstream portion 55 to the upstream portion 57 prior to passing through the air ports 58 into the premixer tubes 52. In this manner, the air flow 59 substantially cools the fuel nozzle 12, and particularly the premixer tubes 52, with greater effectiveness in the downstream portion 55 nearest the hot products of combustion in the combustor 16. The second windows 56 facilitate air flow into premixer tubes 52 more closely or directly into the air ports 58 at the upstream portion 57 of the premixer tubes 52. Only two first windows 54 and second windows 56 are represented in FIG. 7. However, as best seen in FIG. 4, these windows 54 and 56 may be arranged along the entire circumference of the mini-nozzle cap 50.

Air entering the first windows 54 may be directed to the downstream portion 55 of the mini-nozzle cap 50 by a guide or cooling plate 72. As can be seen in FIG. 7, the fuel nozzle 12 distributes the air flow from the first windows 54 both crosswise and parallel to the longitudinal axis of the fuel nozzle 12, e.g., distributing the air flow crosswise about all of the premixer tubes 52 and lengthwise in the upstream direction 59 toward the air ports 58. The air flow 59 from the windows 54 eventually combines with air flow from the windows 56 as the air flows pass through air ports 58 in the premixer tubes 52. As noted above, the air flow 59 from windows 54 substantially cools the fuel nozzle 12 in the downstream portion 55. Thus, due to the hot products of combustion near the downstream portion 55, the air flow 59 from the windows 54 may be approximately 50° F. to 100° F. warmer than air flow from the second windows 56. Therefore, mixing the air from each source may help reduce air temperature entering the premixer tubes 52.

The first windows 54 in the present embodiment are approximately twice as large as the second windows 56. This configuration may ensure that the back side of the mini-nozzle cap 50 is sufficiently cooled, while reducing the air temperature entering the premixer tubes 52. However, window size ratio may vary based on the particular design considerations of the fuel nozzle 12. Furthermore, additional sets of windows may be employed in other embodiments.

The combined air flows enter the premixer tubes 52 through air ports 58 (shown with arrows) located along a perforated section 74 of the tubes 52. As previously discussed, fuel injectors may inject gas fuel, liquid fuel, liquid coolant (e.g., water), or a combination thereof, into the premixer tubes 52. The configuration illustrated in FIG. 7 injects both gas and liquid fuels. Gas may be provided by the galleries 62 located directly below the injector plate 60 in the end cover 38. The same three-gallery configuration presented in FIG. 6 is employed in this embodiment. The first gallery 64 is located below the center premixer tube 52. The second gallery 66 surrounds the first gallery 64 in a coaxial or concentric arrangement, and provides gas to the next outer premixer tubes 52. The third gallery 68 surrounds the second gallery 66 in a coaxial or concentric arrangement, and provides gas to the outer premixer tubes 52. Gas may be injected into the premixer tubes 52 through gas orifices 61. Similarly, liquid may be injected by liquid fuel cartridges 70. The liquid fuel cartridges 70 may inject liquid fuel (and also optional liquid coolant) at a pressure sufficient to induce atomization, or the formation of liquid fuel droplets. The liquid fuel may combine with the gaseous fuel and the air within the perforated section 74 of the premixer tubes 52. Additional mixing of the fuel and air may continue in a non-perforated section 76 downstream from the perforated section 74.

The combination of these two sections 74 and 76 may ensure that sufficient mixing of fuel and air occurs prior to combustion. For example, the non-perforated section 76 forces the air flow 59 to flow further upstream to the upstream portion 57, thereby increasing the flow path and residence time of all air flows passing through the premixer tubes 52. At the upstream portion 57, the air flows from both the downstream windows 54 and the upstream windows 56 pass through the air ports 58 in the perforated section 74, and then travel in a downstream direction 63 through the premixer tubes 52 until exiting into the combustor 16. Again, the exclusion of air ports 58 in the non-perforated section 76 is configured to increase residence time of the air flows in the premixer tubes 52, as the non-perforated section 76 essentially blocks entry of the air flows into the premixer tubes 52 and guides the air flows to the air flows 58 in the upstream perforated section 74. Furthermore, the upstream positioning of the air ports 58 enhances fuel-air mixing further upstream 57, thereby providing greater time for the fuel and air to mix prior to injection into the combustor 16. Likewise, the upstream positioning of the air ports 58 substantially reduces pressure oscillations in the fluid flows (e.g., air flow, gas flow, liquid fuel flow, and liquid coolant flow), as the air ports create crosswise flows to enhance mixing with greater residence time to even out the pressure.

The gaseous fuel flowing through the galleries 62 may also serve to insulate the liquid fuel cartridges 70 and ensure that liquid fuel temperature remains low enough to reduce the possibility of coking. Coking is a condition where fuel begins to crack, forming carbon particles. These particles may become attached to inside walls of the liquid fuel cartridges 70. Over time, the particles may detach from the walls and clog the tip of the liquid fuel cartridge 70. The temperature at which coking occurs varies depending on the fuel. However, for typical liquid fuels, coking may occur at temperatures of greater than approximately 200, 220, 240, 260, or 280° F. As can be seen in FIG. 7, the liquid fuel cartridges 70 are disposed within the galleries 62 and gas orifices 61. Therefore, the liquid fuel cartridges 70 may be completely surrounded by flowing gas. This gas may serve to keep the liquid fuel within the liquid fuel cartridges 70 cool, reducing the possibility of coking.

After the fuel and air have properly mixed in the premixer tubes 52, the mixture may be ignited, resulting in a flame 78 downstream from the downstream portion 55 of each premixer tube 52. As discussed above, the flame 78 heats the fuel-nozzle 12 due to the relatively close location to the downstream portion 55 of the mini-nozzle cap 50. Therefore, as previously discussed, air from the first windows 54 flows through the downstream portion 55 of the mini-nozzle cap 50 to substantially cool the cap 50 of the fuel nozzle 12.

The number of premixer tubes 52 in operation may vary based on desired turbine system output. For example, during normal operation, every premixer tube 52 within the mini-nozzle cap 50 may operate to provide adequate mixing of fuel and air for a particular turbine power level. However, when the turbine system 10 enters a turndown mode of operation, the number of functioning premixer tubes 52 may decrease. When a turbine engine enters turndown, or low power operation, fuel flow to the combustors 16 may decrease to the point where the flame 78 is extinguished. Similarly, under low load conditions, the temperature of the flame 78 may decrease, resulting in increased emissions of oxides of nitrogen (NOx) and carbon monoxide (CO). To maintain the flame 78 and ensure that the turbine system 10 operates within acceptable emissions limits, the number of premixer tubes 52 operating within a fuel nozzle 12 may decrease. For example, the outer ring of premixer tubes 52 may be deactivated by interrupting fuel flow to the outer liquid fuel cartridges 70. Similarly, the flow of gaseous fuel to the third gallery 68 may be interrupted. In this manner, the number of premixer tubes 52 in operation may be reduced. As a result, the flame 78 generated by the remaining premixer tubes 52 may be maintained at a sufficient temperature to ensure that it is not extinguished and emission levels are within acceptable parameters.

In addition, the number of premixer tubes 52 within each mini-nozzle cap 50 may vary based on turbine system 10 design considerations. For example, larger turbine systems 10 may employ a greater number of premixer tubes 52 within each fuel nozzle 12. While the number of premixer tubes 52 may vary, the size and shape of the mini-nozzle cap 50 may be the same for each application. In other words, turbine systems 10 that use higher fuel flow rates may employ mini-nozzle caps 50 with a higher density of premixer tubes 52. In this manner, turbine system 10 construction costs may be reduced because a common mini-nozzle cap 50 may be used for most turbine systems 10, while the number of premixer tubes 52 within each cap 50 may vary. This manufacturing method may be less expensive than designing unique fuel nozzles 12 for each application.

FIG. 8 is a side view of a premixer tube 52 that may be used in the fuel nozzle 12 of FIG. 4. As can be seen in FIG. 8, the premixer tube 52 is divided into the perforated section 74 and the non-perforated section 76. In the illustrated embodiment, the perforated section 74 is positioned upstream of the non-perforated section 76. In this configuration, air flowing into the air ports 58 may mix with fuel entering through the base of the premixer tube 52 via a fuel injector (not shown). The mixing fuel and air may then pass into the non-perforated portion 76, where additional mixing may occur.

Air and fuel pressures typically fluctuate within a gas turbine engine. These fluctuations may drive a combustor oscillation at a particular frequency. If this frequency corresponds to a natural frequency of a part or subsystem within the turbine engine, damage to that part or the entire engine may result. Increasing the residence time of air and fuel within the mixing portion of the combustor 16 may reduce combustor driven oscillations. For example, if air pressure fluctuates with time, longer fuel droplet residence time may allow air pressure fluctuations to average out. Specifically, if the droplet experiences at least one complete cycle of air pressure fluctuation before combustion, the mixture ratio of that droplet may be substantially similar to other droplets in the fuel stream. Maintaining a substantially constant mixture ratio may reduce combustor driven oscillations.

Residence time may be increased by increasing the length of the mixing portion of the combustor 16. In the present embodiment, the mixing portion of the combustor 16 corresponds to the premixer tubes 52. Therefore, the longer the premixer tubes 52, the greater residence time for both air and fuel. For example, the length to diameter ratio of each tube 52 may be at least greater than approximately 5, 10, 15, 20, 25, 30, 35, 40, 45, or 50.

The non-perforated section 76 may serve to increase premixer tube 52 length without allowing additional air to mix with the fuel. In this configuration, the air and fuel may continue to mix after the air has been injected through the air ports 58 and, thus, reduce combustor driven oscillations. In certain embodiments, the length of the perforated section 74 relative to the length of the non-perforated section 76 may be at least greater than approximately 1.5, 2, 2.5, 3, 3.5, 4, 4.5, 5, 5.5, 6, 6.5, 7, 7.5, 8, 8.5, 9, 9.5, or 10, or vice versa. In one embodiment, the length of the perforated section 74 may be approximately 80% of the premixer tube 52 length, while the length of the non-perforated section 76 may be approximately 20% of the tube 52 length. However, the length ratios or percentages between these sections 74 and 76 may vary depending on flow rates and other design considerations. For example, each non-perforated section 76 may have a length ranging from about 15% to 35% of the premixer tube 52 length to increase mixing time and reduce combustor driven oscillations.

Residence time may also be increased by extending the effective path length of fluid flows (e.g., fuel droplets) through the central passage of the premixer tubes 52. Specifically, air may be injected into the premixer tubes 52 in a swirling motion. This swirling motion may induce the droplets to travel through the premixer tubes 52 along a non-linear path (e.g., a random path or a helical path), thereby effectively increasing droplet path length. The amount of swirl may vary based on desired residence time.

Radial inflow swirling may also serve to keep liquid fuel droplets off the inner walls of the premixer tubes 52. If the liquid droplets become attached to the walls, they may remain in the tubes 52 for a longer period of time, delaying combustion. Therefore, ensuring that droplets properly exit the premixer tubes 52 may increase efficiency of the turbine system 10.

In addition, swirling air within the premixer tubes 52 may improve atomization of the liquid fuel droplets. The swirling air may enhance droplet formation and disperse droplets generally evenly throughout the premixer tube 52. As a result, efficiency of the turbine system 10 may be further improved.

As previously discussed, air may enter the premixer tubes 52 through air ports 58. These air ports 58 may be arranged in a series of concentric circles at different axial positions along the length of the premixer tubes 52. In certain embodiments, each concentric circle may have 24 air ports, where the diameter of each air port is approximately 0.05 inches. The number and size of the air ports 58 may vary. For example, premixer tubes 52 may include large teardrop shaped air ports 77 configured to provide enhanced air penetration and mixing. In addition, intermediate sized slotted air ports 79 may be located toward the downstream end of premixer tubes 52 to generate a high degree of swirl. The air ports 58 may be angled along a plane perpendicular to the longitudinal axis of the premixer tube 52. The angled air ports 58 may induce swirl, the magnitude of which may be dependent on the angle of each air port 58.

FIGS. 9, 10, and 11 are simplified cross-sectional views of the premixer tube 52 taken along lines 9-9, 10-10, and 11-11 of FIG. 8, further illustrating angled orientations of the air ports 58 at different axial positions along the length of the tube 52. For example, an angle 80 between air ports 58 and radial axis 81 is illustrated in FIG. 9. Similarly, an angle 82 between air ports 58 and radial axis 83 is illustrated in FIG. 10. Angles 80 and 82 may range between about 0 to 90 degrees, 0 to 60 degrees, 0 to 45 degrees, 0 to 30 degrees, or 0 to 15 degrees. By further example, the angles 80 and 82 may be about 5, 10, 15, 20, 25, 30, 35, 40, or 45 degrees, or any angle therebetween.

In certain embodiments, the angle of the air ports 58 may be the same at each axial location represented by lines 9-9, 10-10, and 11-11, as well as other axial positions along the length of the tube 52. However, in the illustrated embodiment, the angle of the air ports 58 may vary along the length of the tube 52. For example, the angle may gradually increase, decrease, alternate in direction, or a combination thereof. For example, the angle 80 of the air ports 58 shown in FIG. 9 is greater than the angle 82 of the air ports 58 shown in FIG. 10. Therefore, the degree of swirl induced by the air ports 58 in FIG. 9 may be greater than the degree of swirl induced by the air ports 58 in FIG. 10.

The degree of swirl may vary along the length of the perforated portion 74 of the premixer tube 52. The premixer tube 52 depicted in FIG. 8 has no swirl in the lower portion of the perforated section 74, a moderate amount of swirl in the middle portion, and a high degree of swirl in the upper portion. These degrees of swirl may be seen in FIGS. 11, 10 and 9, respectively. In this embodiment, the degree of swirl increases as fuel flows in the downstream direction through the premixer tube 52.

In other embodiments, the degree of swirl may decrease along the length of the premixer tube 52. In further embodiments, portions of the premixer tube 52 may swirl air in one direction, while other portions may swirl air in a substantially opposite direction. Similarly, the degree of swirl and the direction of swirl may both vary along the length of the premixer tube 52.

In yet another embodiment, air may be directed in both a radial and an axial direction. For example, the air ports 58 may form a compound angle within the premixer tube 52. In other words, air ports 58 may be angled in both a radial and axial direction. For example, the axial angle (i.e., angle between air ports 58 and longitudinal axis 84) may range between about 0 to 90 degrees, 0 to 60 degrees, 0 to 45 degrees, 0 to 30 degrees, or 0 to 15 degrees. By further example, the axial angle may be about 5, 10, 15, 20, 25, 30, 35, 40, or 45 degrees, or any angle therebetween. Compound-angled air ports 58 may induce air to both swirl in a plane perpendicular to the longitudinal axis of the premixer tube 52 and flow in an axial direction. Air may be directed either downstream or upstream of the fuel flow direction. A downstream flow may improve atomization, while an upstream flow may provide better mixing of the fuel and air. The magnitude and direction of the axial component of the air flow may vary based on axial position along the length of the premixer tube 52.

Figure 12:
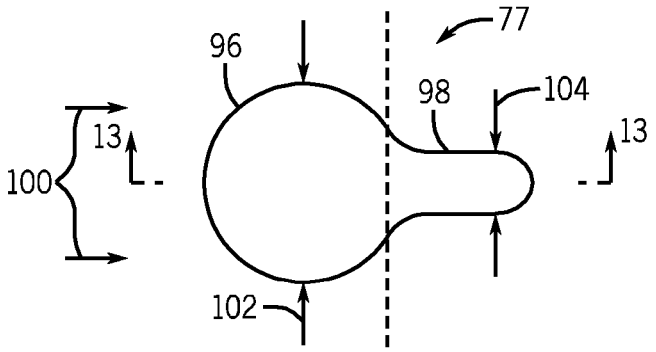
FIG. 12 is a top view of a teardrop shaped air port, as shown in the premixer tube of FIG. 8, in accordance with certain embodiments of the present technique.

FIG. 12 is a top view of an embodiment of a teardrop shaped air port 77 of the premixer tube 52 as illustrated in FIG. 8. The teardrop shaped air port 77 includes a first portion 96 (e.g., large opening) and a second portion 98 (e.g., small opening) disposed one after another along a flow direction 100 through the central passage of the premixer tube 52. The second portion 98 is narrower than the first portion 96, and the second portion 98 is elongated in the flow direction 100. For example, a first width 102 of the first portion 96 may be greater than a second width 104 of the second portion 98 by a factor of approximately 1.5 to 5, 2 to 4, or about 3. In the illustrated embodiment, the first portion 96 is a generally circular or oval shaped opening, whereas the second portion 98 is a generally elongated slot shaped opening. In certain embodiments, the teardrop shaped air port 77 may be configured as an airfoil shaped opening, which gradually decreases in width from the first portion 96 to the second portion 98. As previously discussed, the teardrop shaped air port 77 is configured to provide enhanced air penetration and mixing. In particular, the first portion 96 is configured to provide the majority of the air injection, while the second portion 98 is configured to reduce or prevent recirculation (e.g., low velocity zone) downstream of the majority air injection through the first portion 96.

Figure 13:
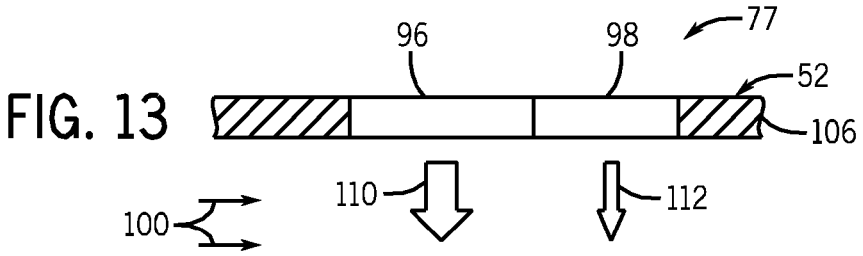
FIG. 13 is a cross-sectional side view of the teardrop shaped air port, taken along line 13-13 of FIG. 12, in accordance with certain embodiments of the present technique.

FIG. 13 is a cross-sectional view of a wall 106 of the premixer tube 52 taken along line 13-13 of FIG. 12, illustrating operation of the first and second portions 96 and 98 of the teardrop shaped air port 77. As illustrated, the first and second portions 96 and 98 of the teardrop shaped air port 77 inject first and second air flows 110 and 112 (or air flow portions), respectively, into the flow 100 moving through the central passage of the premixer tube 52. The first and second air flows 110 and 112 are both oriented crosswise (e.g., perpendicular) to the flow 100, thereby causing the flow 100 to collide with the first air flow 110 prior to the second air flow 112. In other words, the teardrop shaped air port 77 may be described as projecting a teardrop shaped stream of air crosswise into the flow 100. If the port 77 is shaped as an airfoil, then the port 77 may be described as projecting an airfoil shaped stream of air crosswise into the flow 100. Regardless of the shape, the flow 100 impacts the first air flow 110 upstream of the second air flow 112.

In the illustrated embodiment, the first and second air flows 110 and 112 have different magnitudes (e.g., air flow rates) correlated to the size of the first and second portions 96 and 98, as indicated by the differently sized arrows 110 and 112. For example, the first air flow 110 may be greater than the second air flow 112 by a factor of approximately 1.5 to 5, 2 to 4, or about 3. Thus, the first portion 96 of the teardrop shaped air port 77 is configured to provide a greater penetration of air flow 110 through the first portion 96 into the flow 100 moving through the central passage of the premixer tube 52, thereby increasing the mixture of air and fuel. The second portion 98 of the tear drop shaped air port 77 provides a lesser penetration of air 112 into the flow 100 moving through the central passage of the premixer tube 52, thereby reducing or preventing the formation of a recirculation zone and lessening the possibility of flame holding. The absence of the elongated second portion 98 of the teardrop shaped air port 77 may allow the formation of a recirculation zone downstream of the first portion 96, because the first air flow 110 could substantially block the flow 110 from reaching the region immediately downstream from the first air flow 110. The second portion 98 injects the second air flow 112 into this region, thereby ensuring sufficient air flow and mixing directly downstream of the first air flow 110.

Figure 14:
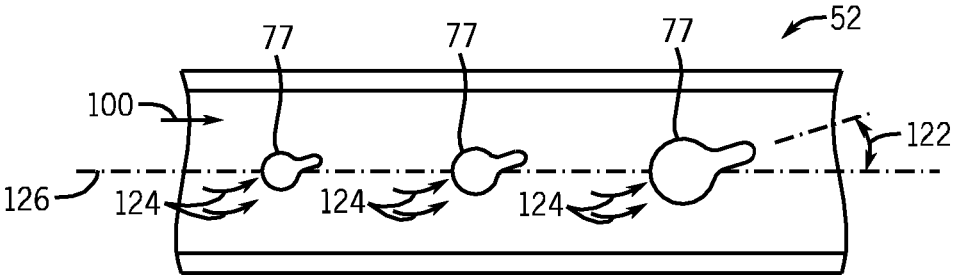
FIG. 14 is a partial cross-sectional side view of a premixer tube in accordance with certain embodiments of the present technique.

FIG. 14 is a partial cross-sectional view of an embodiment of the premixer tube 52, illustrating a plurality of teardrop shaped air ports 77 disposed one after another at different axial positions. In the illustrated embodiment, each subsequent teardrop shaped air port 77 changes (e.g., increases) in total area in the direction of flow 100 along the length of the premixer tube 52. For example, relative to an immediately preceding (i.e., upstream) port 77, each subsequent teardrop shaped air port 77 may increase in total area (i.e., incremental growth) by approximately 5 to 200 percent, 10 to 100 percent, or 20 to 50 percent. By further example, the incremental growth from one teardrop shaped air port 77 to another may be approximately 5, 10, 15, 20, 25, 30, 35, 40, 45, or 50 percent. In some embodiments, premixer tube 52 may include a plurality of teardrop shaped air ports 77 at each axial position along the direction of flow 100, and the ports 77 may be axially aligned or staggered relatively to one another from one axial position to another. The incremental growth in total area of each teardrop shaped air port 77 may be configured to provide sufficient air penetration into the flow 100, based on the progressively greater flow 100 in the downstream direction. In other words, given that the flow 100 progressively increases in magnitude in the downstream direction, equally sized teardrop shaped air ports 77 may become progressively less effective in the downstream direction. Thus, by using progressively larger sized teardrop shaped air ports 77 in the downstream direction, the ports 77 are able to provide sufficient penetration into the flow 100 to increase fuel to air mixing.

As further illustrated in FIG. 14, each teardrop shaped air port 77 may orient the second portion 98 at an angle 122 non-parallel to a longitudinal axis 126 of the central passage of the premixer tube 52. In addition, the flow 100 through the premixer tube 52 may include a swirling flow 124, which also may be oriented at the angle 122 non-parallel to the longitudinal axis 126 of the central passage of the premixer tube 52. Aligning the second portion 98 of the teardrop shaped air port 77 with the swirling flow 124 enables the second portion 98 to reduce or prevent the formation of recirculation zones downstream of the first portion 96, as discussed above. The angle 122 of the second portion 98 of the teardrop shaped air port 77 relative to the longitudinal axis 126 of the central passage of the premixer tube 52 may range between approximately 0 to 90 degrees, 5 to 85 degrees, 5 to 75 degrees, 5 to 60 degrees, 5 to 45 degrees, 5 to 30 degrees, or 5 to 15 degrees. By further example, the angle 122 may be approximately 5, 10, 15, 20, 25, 30, 35, 40, or 45 degrees, or any angle therebetween.

Figure 15:
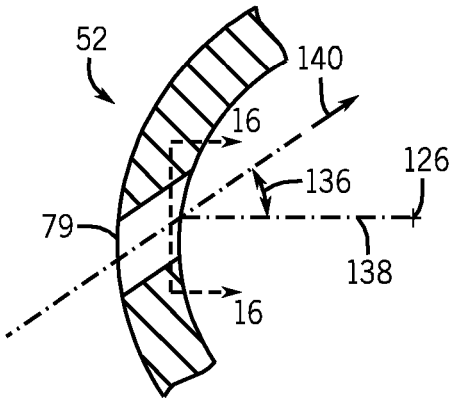
FIG. 15 is a partial cross-sectional side view of a premixer tube in accordance with certain embodiments of the present technique.

FIG. 15 is a partial cross-sectional front view of an embodiment of the premixer tube 52 of FIG. 8, illustrating an angled orientation of the intermediate sized slotted air ports 79 at the downstream end of the premixer tubes 52 to generate swirl. As shown in FIG. 8, the intermediate sized slotted air ports 79 may be offset or aligned along the length of the premixer tubes 52. As illustrated in FIG. 15, each intermediate sized slotted air port 79 may be angled to direct air flow 140 into the central passage at an angle 136 away from a plane 138 perpendicular to the longitudinal axis 126 of the premixer tube 52. The angle 136 of the intermediate sized slotted air port 79 (and its air flow 140) relative to the plane 138 perpendicular to the longitudinal axis 126 of the central passage of the premixer tube 52 may range between about 0 to 90 degrees, 5 to 85 degrees, 5 to 60 degrees, 5 to 45 degrees, 5 to 30 degrees, or 5 to 15 degrees. By further example, the angle 136 may be approximately 5, 10, 15, 20, 25, 30, 35, 40, or 45 degrees, or any angle therebetween.

Figure 16:
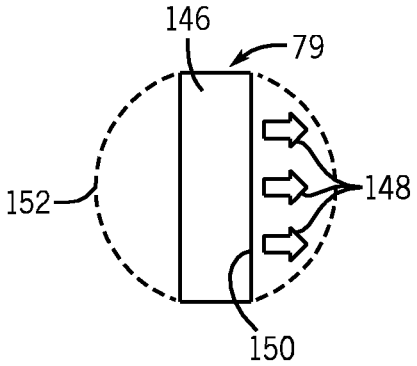
FIG. 16 is a cross-sectional side view of the premixer tube, taken along line 16-16 of FIG. 15, in accordance with certain embodiments of the present technique.

FIG. 16 is a cross-sectional view of a portion of the premixer tube 52 taken along line 16-16 of FIG. 15, illustrating how a rectangular opening 146 of the intermediate sized slotted air port 79 concentrates an air flow 148 along a straight flat edge 150 in a circumferential direction about the longitudinal axis 126 of the premixer tube 52. In particular, arrows 148 represent substantially uniform air flows (e.g., equal air velocities) exiting from the rectangular opening 146 along the straight flat edge 150. In sharp contrast, a curved edge (e.g., a circular opening) would introduce air flows at different positions along the curved edge, thereby introducing air in a non-uniform manner. In other words, the rectangular opening 146 and its straight flat edge 150 are oriented parallel to the longitudinal axis 126 of the premixer tube 52, whereas the curved edge would not be parallel to the longitudinal axis 126. Accordingly, the intermediate sized slotted air port 79 injects the air flow 148 into the premixer tube 52 as an air sheet parallel but offset from the longitudinal axis 126, thereby inducing swirling flow with increased effectiveness due to the uniform air flows 148 along the straight flat edge 150. Again, if the intermediate sized slotted air port 79 lacked the flat edge 150, but rather included a circular shape 152, then the air flow 148 would not concentrate in a circumferential direction (i.e., directly aligned with the longitudinal axis 126). Similar to the alignment of the teardrop shaped air port 77 with the flow 100, the alignment of the intermediate sized slotted air port 79 with the flow 100 reduces the possibility of a recirculation zone (e.g., low velocity region) forming downstream from the port 79.

Figure 17:
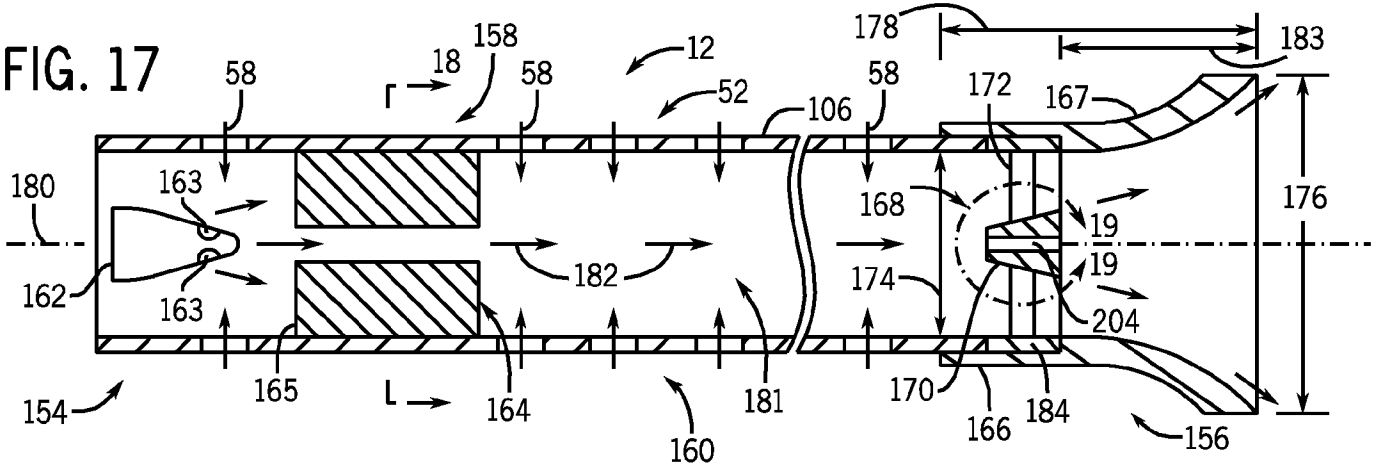
FIG. 17 is a cross-sectional side view of a premixer tube in accordance with certain embodiments of the present technique.

FIG. 17 is a cross-sectional view of an embodiment of a premixer tube 52 of a fuel nozzle 12, illustrating an upstream fuel injection section 154, a downstream flame stabilizing section 156, an intermediate catalytic section 158, and an intermediate air injection section 160. In the illustrated embodiment, the upstream fuel injection section 154 includes a fuel injector 162 having one or more fuel ports 163 disposed inside the wall 106 of the premixer tube 52. The intermediate catalytic section 158 includes an interior catalytic region 164 having a catalytic structure 165 extending radially into the premixer tube 52 from the wall 106. The flame stabilizing section 156 includes an outlet region 166 having a bell-shaped structure 167 disposed concentrically about a flame stabilizer 168, wherein the flame stabilizer 168 includes a center body 170 supported by multiple struts 172 extending to the wall 106 of the premixer tube 52. As discussed further below, the bell-shaped structure 167 is an annular structure that progressively expands from an upstream end portion (e.g., upstream diameter 174) to a downstream end portion (e.g., downstream diameter 176) over a length 178 of the bell-shaped structure 167. The intermediate air injection section 160 includes multiple air ports 58 to inject air crosswise to a longitudinal axis 180 of the premixer tube 52, e.g., crosswise to flow 182 along a central passage 181 inside the premixer tube 52. As illustrated, the air ports 58 are positioned axially between the fuel injector 162 and the flame stabilizer 168, while also being positioned both upstream and downstream from the interior catalytic region 164. As discussed below, the interior catalytic region 164 is configured to increase the reaction between fuel and air inside the premixer tube 52.

Fuel may be injected via the fuel injector 162 upstream of the catalytic region 164 and mix with air entering the central passage 181 of the premixer tube 52 through multiple air ports 58. In some embodiments, the multiple air ports include a first air port 58 disposed upstream of the catalytic region 164 and a second air port 58 downstream of the catalytic region 164. The mixture of air and fuel flows downstream 182 through the central passage 181 of the premixer tube 52 entering the catalytic region 164, where the catalyst pre-reacts a portion of the air-fuel mixture to stabilize combustion occurring in the combustor 16.

The catalytic region 164 may include a catalytic coating of a catalyst material disposed directly or indirectly along an inner surface of the wall 106 of the premixer tube 52. For example, a substrate material (e.g., washcoat) may be deposited on the inner surface of the wall 106 of the premixer tube 52 and the catalyst material then deposited on the substrate material. In some embodiments, the catalytic region 164 may include a catalytic insert of the catalyst disposed along an inner surface of the wall 106 of the premixer tube 52, or the entire wall 106 may be defined by the catalytic insert in the catalytic region 164. In addition, the illustrated embodiment of the catalytic region 164 includes the catalytic structure 165 extending radially into the premixer tube 52 from the wall 106. The catalytic structure 165 may be made entirely of a catalyst material, or the catalytic structure 165 may include a catalytic coating of a catalyst material along a surface of a non-catalytic core structure. In other embodiments, the catalytic structure 165 may be offset away from an inner surface of the wall 106 along the central passage 181 of the premixer tube 52. In general, the catalytic region 164 provides a catalyst material on a sufficient surface area to pre-react the fuel and air inside the premixer tube 52. In certain embodiments, the catalyst material may include a noble metal, such as gold, platinum, palladium, or rhodium, or a rare earth metal, such as cerium or lanthanum, or other metals, such as nickel or copper, or any combination thereof. Furthermore, in certain embodiments, the flow through the catalytic region 164 contains a fuel rich mixture of fuel and air. For example, the ratio of fuel to air may range between approximately 1.5 to 10, 2 to 8, 3 to 7, or 4 to 6. By further example, the fuel to air ratio may be at least greater than approximately 1.5, 2, 3, 4, or 5, or any ratio therebetween. The fuel rich flow reduces the possibility of auto ignition or flame holding when the axial velocity is relatively low.

As further illustrated in FIG. 17, the outlet region 166 is configured to reduce the pressure dump loss and stabilize the flame downstream from the premixer tube 52. In particular, the outlet region 166 includes the bell-shaped structure 167 (e.g., annular bell-shaped wall), which gradually expands along the length 178 from the upstream end portion 174 to the downstream end portion 176 in the shape of a bell. The gradual expansion may occur in a nonlinear manner along the length 178 of the bell-shaped structure 167. In certain embodiments, the downstream diameter 176 may be at least greater than 5, 10, 15, 20, 25, 50, 75, or 100 percent greater than the upstream diameter 174. For example, the downstream diameter 176 may be a factor of approximately 1.1 to 10 times greater than the upstream diameter 174. However, the factor may range between approximately 1 to 10, 1 to 5, 1 to 3, 1 to 2, or 1 to 1.5. The ratios or percentages between the diameters 174 and 176 may vary depending on flow rates and other considerations. The gradual expansion through the bell-shaped structure 167 gradually decreases the velocity of the flow 182 of the air and fuel mixture, thereby enabling pressure recovery prior and flame stabilization.

Inside the bell-shaped structure 167, the outlet region 166 also includes the flame stabilizer 168. In certain embodiments, the flame stabilizer 168 may be upstream and/or directly concentric with an expanding portion 183 of the bell-shaped structure 167. In the illustrated embodiment, the flame stabilizer 168 is shown upstream from the expanding portion 183, while still being within the bell-shaped structure 167. However, the flame stabilizer 168 may be moved downstream into the expanding portion 183 in alternative embodiments. As illustrated, the flame stabilizer 168 includes an outer ring 184, the center body 170, and multiple struts 172 extending from the outer ring 184 to the center body 170. For example, the center body 170 may be an aerodynamic structure or expanding cylindrical structure (e.g., a conical structure), which generally expands in diameter in the downstream direction 182. The multiple struts 172 may be described as radial struts or supports, and may range from 1 to 20, 2 to 10, or 4 to 6 struts in certain embodiments. As discussed in detail below, the center body 170 includes a central passage 204 extending axially through the center body 170 from an upstream to a downstream side, thereby directing a portion of the flow 182 into the region directly downstream of the downstream side of the center body 170. In this manner, the central passage 204 reduces the possibility of a low velocity region forming downstream of the center body 170, and thus reduces the possibility of flame holding directly onto the center body 170. In other words, the central passage 204 may serve to push the flame further downstream away from the center body 170.

Figure 18:
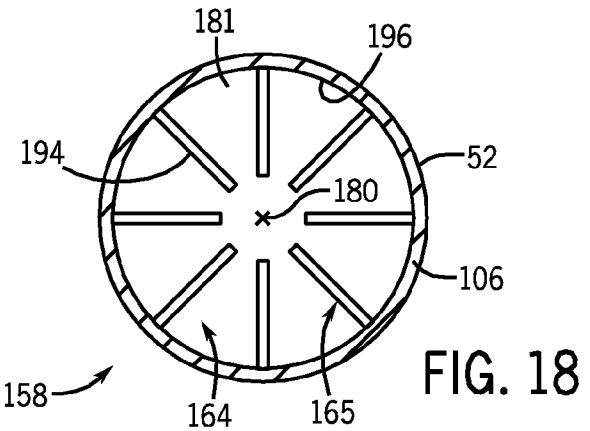
FIG. 18 is a cross-sectional front view of the premixer tube, taken along line 18-18 of FIG. 17, in accordance with certain embodiments of the present technique.

FIG. 18 a cross-sectional front view of the premixer tube 52 taken along line 18-18 of FIG. 17, illustrating an embodiment of the catalytic region 164 having multiple catalytic structures 165 inside the central passage 181. In the illustrated embodiment, the catalytic structures 165 include multiple fins 194 extending radially inward from an inner surface 196 of the wall 106 toward the central longitudinal axis 180 of the premixer tube 52. The fins 194 may vary in number, size, and shape in various embodiments. However, the illustrated embodiment includes eight fins 194 that converge toward a central region about the longitudinal axis 180. These fins 194 may be flat plates that are aligned with the longitudinal axis 180. In some embodiments, the fins 194 may be made entirely out of a catalytic material, such as a noble metal. However, other embodiments of the fins 194 may be made with non-catalytic materials having a catalytic coating. Furthermore, the inner surface 196 of the wall 106 may include a catalytic coating, or a section of the wall 106 may be made entirely with a catalytic material. For example, the catalytic region 164 may include an annular wall section having the fins 194, wherein the annular wall section and the fins 194 are entirely made of a catalytic material. By further example, the catalytic region 164 may include an annular wall section having the fins 194, wherein the annular wall section and the fins 194 are made of a non-catalytic material with a catalytic coating. As noted above, the catalyst material may include a noble metal, such as gold, platinum, palladium, or rhodium, or a rare earth metal, such as cerium or lanthanum, or other metals, such as nickel or copper, or any combination thereof.

Figure 19:
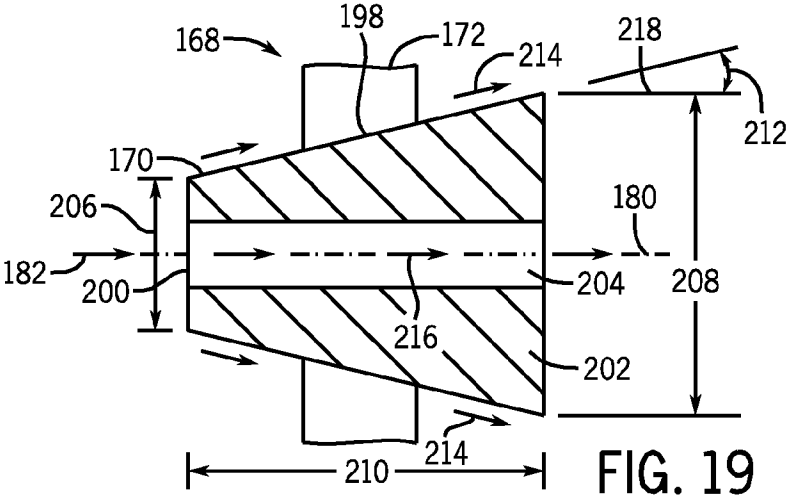
FIG. 19 is a cutaway view of a flame stabilizer of the premixer tube, as shown in FIG. 17, in accordance with certain embodiments of the present technique.

FIG. 19 is a cutaway cross-sectional side view of an embodiment of the flame stabilizer 168 taken within line 19-19 of FIG. 17. As illustrated, the center body 170 includes a tapered outer surface 198 that gradually expands from an upstream side 200 to a downstream side 202 of the center body 170. The tapered outer surface 198 may be an aerodynamic surface or an expanding cylindrical surface (e.g., a conical surface), which generally expands in diameter in the downstream direction 182 from an upstream diameter 206 to a downstream diameter 208 along a length 210. For example, the tapered outer surface 198 may have an angle 212 relative to the longitudinal axis 180. In addition, tapered outer surface 198 is coaxial or concentric with the central passage 204, which extends completely through the center body 170 from the upstream side 200 to the downstream side 202. As noted above, the central passage 204 reduces the possibility of low velocity regions, and thus flame holding, directly downstream of the center body 170 (i.e., adjacent the downstream side 202).

As illustrated in FIG. 19, the flow 182 splits into a first flow portion 214 and a second flow portion 216 upon reaching the center body 170 of the flame stabilizer 168. In particular, the first flow portion 214 extends along the tapered outer surface 198, while the second flow portion 216 extends through the central passage 204. The first flow portion 214 externally cools (e.g., external convective cooling) the center body 170, while the second flow portion 216 internally cools (e.g., internal convective cooling) the center body 170. The expanding diameter of the tapered outer surface 198 ensures that the first flow portion 214 flows in close proximity to the surface 198, thereby increasing the cooling and reducing the possibility of low velocity regions and flame holding along the surface 198. The second flow portion 216 routes flow directly into the otherwise low velocity region direction downstream from the center body 170 (i.e., directly downstream from the downstream side 202), thereby reducing or preventing the possibility of flame holding in close proximity to the center body 170. In other words, the central passage 204 directs the second flow portion 216 within a central portion of the downstream side 202, thereby creating a downstream flow pushing the flame further downstream away from the center body 170. Thus, the central passage 204 limits the possibility of recirculation and sets the flame holding at a desired offset position downstream of the center body 170. In certain embodiments, the central passage 204 may be varied in diameter and length 210 to control the offset of the flame downstream from the center body 170. For example, a larger diameter may increase the offset, while a smaller diameter may decrease the offset. In certain embodiments, the center body 170 may include more than one passage 204, e.g., 1 to 10 passages at central and off-center positions relative to the longitudinal axis 180.

The angle 212 of the tapered outer surface 198 of the center body 170 relative to the longitudinal axis 180, as indicated by parallel axis 218, affects the boundary layer around the center body 170 and the velocity of the first flow portion 214 around the center body 170. For example, the angle 212 may be increased to decrease the boundary layer of the first flow portion 214, while the angle 212 may be decreased to increase the boundary layer of the first flow portion 214. In certain embodiments, the premixer tube 52 gradually increases the flow 182 and the magnitude of swirl in the downstream direction 182, thereby increasing the tendency of the flow 182 to expand about the center body 170 and through the bell-shaped structure 167. Accordingly, the angle 212 of the tapered outer surface 198 of the center body 170 reinforces the tendency of the flow 182 to expand or diffuse in the downstream direction 182. In certain embodiments, the angle 212 may range between approximately 0 to 90 degrees, 0 to 60 degrees, 0 to 45 degrees, 0 to 30 degrees, or 0 to 15 degrees. By further example, the angle 212 may be approximately 5, 10, 15, 20, 25, 30, 35, 40, or 45 degrees, or any angle therebetween.

The angle 212 also may be defined with reference to the ratio of the diameter at the downstream end 208 to the diameter at the upstream end 206 of the center body 170. As the ratio increases between the diameter at the downstream end 208 and the upstream end 206, the angle 212 increases. The ratio of the diameters 206 and 208 also affects the amount of blockage of the flow 182 through the premixer tube 52. Increasing the diameter at the downstream end 208 of the center body 170 increases the blockage of the flow 182, resulting in better flame stabilization but increases the pressure drop. The diameter of the center body 170 may vary along the length 210 of the center body 170. The ratio of the diameter at the downstream end 208 to the diameter at the upstream end 206 may range between approximately 8 to 1, 6 to 1, 4 to 1, 3 to 1, or 2 to 1. By further example, the ratio may be approximately 5, 4, 3, 2, or 1.5. In some embodiments, the diameter at the downstream end 208 may be approximately 50% of the diameter at the upstream end 206 of the center body 170.

Figure 20:
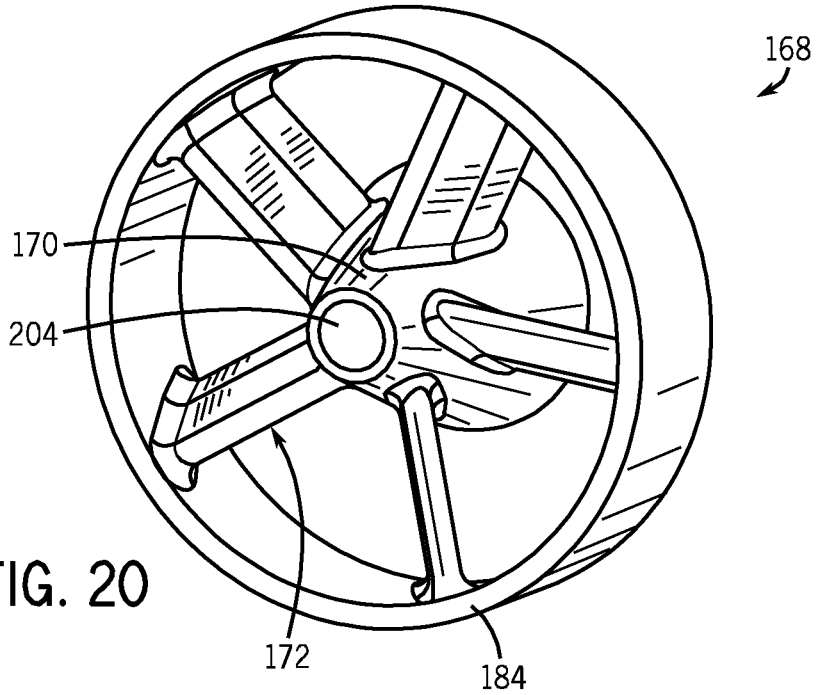
FIG. 20 is a front perspective view of the flame stabilizer of FIG. 19, in accordance with certain embodiments of the present technique.
Figure 21:
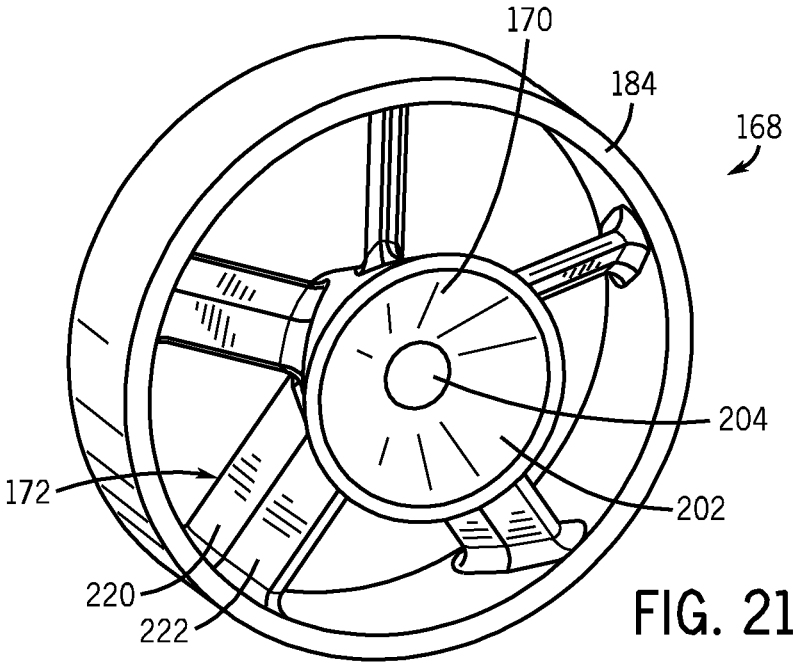
FIG. 21 is a rear perspective view of the flame stabilizer of FIG. 19, in accordance with certain embodiments of the present technique.

FIGS. 20 and 21 are front and rear perspective views of an embodiment of the flame stabilizer 168 as illustrated in FIG. 17. In the illustrated embodiment, the center body 170 is supported within the ring 184 by five equally spaced struts 172. However, any number, shape, and configuration of struts 172 may be used to support the center body 170 within the ring 184. The struts 172 may be generally flat plate structures or aerodynamic structures to reduce flow resistance in the premixer tube 52. In the illustrated embodiment, the struts 172 are angled to induce and/or align with swirling flow inside the premixer tube 52. However, alternative embodiments may orient the struts 172 in alignment with the longitudinal axis 180. As further illustrated in FIG. 21, the struts 172 may include an upstream portion 220 followed by a downstream portion 222, wherein the downstream portion 222 is tapered relative to the upstream portion 220. The taper of the downstream portion 222 may be configured to increase aerodynamics, thereby reducing flow resistance and reducing the possibility of recirculation (e.g., low velocity regions and flame holding) downstream of the struts 172. Overall, the flame stabilizer 168 is configured to provide integral convective cooling (e.g., internal and external), while simultaneously controlling the flame position downstream from the center body 170.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

The invention claimed is:

1. A system, comprising:

a fuel nozzle, comprising:

a fuel injector having a conical body portion comprising a fuel port; and a premixer tube, comprising:

a wall disposed about a central passage;

a plurality of air ports extending through the wall into the central passage; and a catalytic region comprising a catalyst disposed inside the wall along the central passage, wherein the catalyst is configured to increase a reaction of fuel and air, wherein the catalytic region comprises a catalytic structure extending radially inward and away from an inner surface of the wall into the central passage, the catalytic structure comprising a plurality of flat catalytic fins extending from the inner surface, and wherein the conical-shaped fuel injector is disposed inside the premixer tube upstream from the catalytic region.

2. The system of claim 1, wherein the catalytic region comprises a catalytic coating of the catalyst disposed along an inner surface of the wall.

3. The system of claim 1, wherein the catalytic region comprises a catalytic insert of the catalyst disposed along an inner surface of the wall.

4. The system of claim 1, wherein the catalytic region contains a fuel rich mixture of the fuel and air.

5. The system of claim 1, wherein the catalyst comprises a noble metal.

6. The system of claim 1, wherein the plurality of air ports comprises a first air port disposed upstream of the catalytic region that extends through the wall into the central passage, and the plurality of air ports comprises a second air port disposed downstream of the catalytic region that extends through the wall into the central passage.

7. The system of claim 1, wherein the plurality of air ports comprises a teardrop shaped air port having first and second portions disposed one after another along a flow direction through the central passage, wherein the second portion is narrower than the first portion, and the second portion is elongated along the flow direction.

8. The system of claim 1, wherein the premixer tube comprises an outlet having a gradually expanding annular portion of the wall that forms a bell-shape.

9. The system of claim 1, wherein the premixer tube comprises an outlet having a flame stabilizer, wherein the flame stabilizer comprises an outer ring, a center body, a plurality of struts extending from the outer ring to the center body, wherein the center body comprises a central passage extending from an upstream side to a downstream side of the center body and the central passage extends through the center body, and the center body comprises an outer surface that expands in diameter from the upstream side to the downstream side.

10. A system, comprising:

a fuel nozzle, comprising:

a fuel injector comprising a fuel port; and a premixer tube, comprising:

a wall disposed about a central passage;

a plurality of air ports extending through the wall into the central passage;

an outlet region comprising a bell-shaped wall and a flame stabilizer, wherein the bell-shaped wall comprises a non-expanding portion located upstream of an expanding portion, and the non-expanding portion is concentrically disposed about a downstream end of the wall and the flame stabilizer; and a catalytic region comprising a catalyst disposed inside the wall along the central passage, wherein the catalyst is configured to increase a reaction of fuel and air, wherein the catalytic region comprises a catalytic structure extending radially inward and away from an inner surface of the wall into the central passage, the catalytic structure comprising a plurality of flat catalytic fins extending from the inner surface, and wherein the fuel injector is disposed inside the premixer tube upstream from the catalytic region.

11. The system of claim 10, wherein the bell-shaped wall comprises an annular wall having a diameter that gradually expands from the upstream end portion to a downstream end portion.

12. The system of claim 11, wherein the diameter of the annular wall gradually expands in a non-linear manner.

13. The system of claim 10, wherein the flame stabilizer is disposed upstream of the bell-shaped wall.

14. The system of claim 10, wherein the flame stabilizer comprises an outer ring, a center body, a plurality of struts extending from the outer ring to the center body.

15. The system of claim 14, wherein the center body comprises a central passage extending from an upstream side to a downstream side of the center body and the central passage extends through the center body, and the center body comprises a conical outer surface that expands in diameter from the upstream side to the downstream side.

16. A system, comprising:

a fuel nozzle, comprising:

a fuel injector having a conical body portion comprising a fuel port; and a premixer tube, comprising:

a wall disposed about a central passage;

a plurality of air ports extending through the wall into the central passage, wherein the plurality of air ports comprises a first teardrop shaped air port having first and second portions disposed one after another along a flow direction through the central passage, wherein the second portion is narrower than the first portion, the second portion comprises a constant width along a portion of a length of the second portion, and the second portion is elongated along the flow direction, wherein the conical-shaped fuel injector is disposed inside the premixer tube; and a catalytic region comprising a catalyst disposed inside the wall along the central passage, wherein the catalyst is configured to increase a reaction of fuel and air, wherein the catalytic region comprises a catalytic structure extending radially inward and away from an inner surface of the wall into the central passage, the catalytic structure comprising a plurality of flat catalytic fins extending from the inner surface, and wherein the conical-shaped fuel injector is disposed inside the premixer tube upstream from the catalytic region.

17. The system of claim 16, wherein the flow direction and the second portion are oriented at an angle non-parallel to a longitudinal axis of the central passage.

18. The system of claim 16, comprising a second teardrop shaped air port downstream from the first teardrop shaped air port, wherein a first total area of the first teardrop shaped air port is smaller than a second total area of the second teardrop shaped air port.

19. A system, comprising:

a fuel nozzle, comprising:

a fuel injector having a conical body portion comprising a fuel port; and a premixer tube, comprising:

a wall disposed about a central passage;

a plurality of air ports extending through the wall into the central passage;

a catalytic region comprising a catalyst disposed inside the wall along the central passage, wherein the catalyst is configured to increase a reaction of fuel and air, wherein the conical-shaped fuel injector is disposed inside the premixer tube upstream from the catalytic region; and an outlet having a flame stabilizer, wherein the flame stabilizer comprises an outer ring, a center body, a plurality of struts extending from the outer ring to the center body, wherein the center body comprises a central passage extending from an upstream side to a downstream side of the center body, the central passage extends through the center body, and the center body comprises an outer surface that expands in diameter in a downstream direction from the upstream side to the downstream side.

* * * * *